United States Patent [19]

Smith

[11] 4,031,862

[45] June 28, 1977

[54] ECONOMIZER

[76] Inventor: Frank J. Smith, 7352 Limekiln Pike, Philadelphia, Pa. 19138

[22] Filed: Mar. 10, 1976

[21] Appl. No.: 665,501

[52] U.S. Cl. ..... 122/421; 122/392; 122/DIG. 13

[51] Int. Cl.[2] ..... F23J 3/02; F22D 1/02

[58] Field of Search ..... 122/140 A, 144, 235 A, 122/235 B, 235 C, 262, 390, 392, 421, DIG. 13; 62/59 A

[56] References Cited

UNITED STATES PATENTS

| | | | |
|---|---|---|---|
| 2,551,137 | 5/1951 | Kennedy | 122/421 |
| 2,795,213 | 6/1957 | Cooper | 122/421 |
| 2,797,669 | 7/1957 | Nalven | 122/392 |
| 3,768,447 | 10/1973 | Kallstrand | 122/421 |

*Primary Examiner*—Kenneth W. Sprague

*Attorney, Agent, or Firm*—Howson and Howson; Richard D. Weber

[57] ABSTRACT

An economizer for extracting heat energy from low temperature flue gases while simultaneously removing therefrom contaminates consisting chiefly of oxides and oxygen acids of sulfur. The economizer includes a plurality of heat exchange tube assemblies, each of which comprises concentrically spaced inner and outer tubes of different materials. The spaces between the concentric tubes are filled with graphite which remains in heat conductive contact with the inner and outer tubes while accommodating their differential rates of thermal expansion and contraction upon heating and cooling. In the preferred form of the invention, the outer tube is made of low expansion borosilicate glass, while the inner tube is of copper. The flue gases flow transversely to the tube assemblies while water is rapidly circulated through the copper tubes in order to absorb efficiently the heat conducted sequentially through the glass, graphite and the copper materials.

8 Claims, 11 Drawing Figures

ECONOMIZER

The present invention relates generally to heat exchange equipment and relates more particularly to a novel economizer for extracting heat energy from corrosive low temperature flue gases while removing therefrom contaminants consisting chiefly of oxides and oxygen acids of sulfur.

The flue gases from boilers an other fuel burning equipment without steaming economizers and/or air heaters contain large amounts of useful heat which ordinarily is released to the atomosphere at temperatures as high as 600° F. The primary reason for allowing the escape of these hot gases has been to prevent the corrosion of the last passes of steam generating equipment which would occur at and below the dew point of the acids formed by sulfur oxides present in varying degrees in most flue gases. Prior to the skyrocketing fuel oil price increases of a few years ago, the cost of removing the heat energy from the low temperature flue gases has exceeded the cost of the fuel required to produce the same amount of heat and it accordingly was not economical to undertake the recovery effort. With the sharp rise in the cost of fuel, the increased emphasis on fuel conservation and concern with environmental protection, the recovery of the presently wasted flue gas heat energy is receiving much attention although the corrosion problems have heretofore not been satisfactorily overcome.

Recent attempts to build heat exchange devices which would be relatively unaffected by the corrosive conditions of low temperature flue gases have included air heaters comprising a plurality of glass tubes arranged transversely to the flue gas flow. Breakage of the glass has been a problem, apparently due to a combination of factors including thermal stresses, difficulties in mounting the glass tube ends, the forces placed on the glass tubes by the soot blowers, and the buildup of contaminants on the exterior of the tubes. Since glass is not a particularly good conductor of heat, it is desirable to keep the tube as thin as possible but the strength of the tube is then diminshed, increasing the possibility of breakage. Furthermore, air heaters require extensive surface areas even when constructed of materials which are good heat conductors. The relatively high cost of the glass tubes, the large number of tubes required, and the fragility of the tubes has restricted their use in flue gas heat exchangers to a relatively small number of installations.

In the present invention, a novel heat exchange tube assembly is provided which permits the use of combinations of dissimilar materials to take advantage of their desirable characteristics. Broadly stated, the present tube assembly comprises an outer tube of a first material, an inner tube of a second material coaxially disposed in spaced relation within the outer tube, and an intermediate layer of graphite completely filling the annular space between the tubes. The graphite layer, because of its unique properties, accommodates the differential rates of expansion of the different materials while remaining in intimate contact therewith to provide maximum heat conduction.

In the preferred form of the invention, the outer tube is made of borosilicate glass, while the inner tube is of copper through which water is circulated and heated. A plurality of such tube assemblies are disposed transversely to a flow of flue gas and are preferably arranged in countercurrent fashion with the flue gas descending and the water ascending. The heat conducting characteristic of the graphite although greater than that of glass is considerably below that of the copper and provides a uniform heat transfer without danger of thermal stresses developing which might cause breakage of the glass. Since the glass is impervious to attack by the sulfur components in any form, air is introduced at gas temperatures between 425° and 450° F. since at these temperatures, and especially in contact with proper catalysts, the conversion of sulfur dioxide to sulfur trioxide is greatly accelerated. Likewise, the conversion of the sulfur trioxide into sulfuric acid is made rapid by adding moisture since said trioxide has great affinity for warer.

For the more rapid and efficient extraction of heat energy from flue gases at a temperature above 500° F., or for the very low temperature flue gases having no oxides or oxygen acids of sulfur for which the glass jacketed tube assemblies would provide two slow a rate of heat exchange, a modified form of the invention may be employed wherein the outer tube assembly is made of metal, preferably steel. For use with very low temperature flue gases, for example below 200° F., the steel jacketed tube assemblies are preferably sprayed with a lime solution to prevent external corrosion of the tubes.

An economizer utilizing the novel tube assembly of the present invention may include only an array of the preferred glass-jacketed tube assemblies which is suited for operation in the flue gas temperature range of approximately 500° F. to 200° F. In addition, a further stage of heat exchange tube assemblies utilizing steel outer tubes may be employed to recover heat from the flue gases below approximately 200° F. In those instances in which the flue gases are passed to the economizer at temperatures considerably in excess of 500° F., a preliminary stage of steel jacketed tube assemblies may be employed prior to the glass-jacketed tube assembly stage. A damper controlled bypass operable at light loads when the exit flue gas temperatue from the steel jacketed tube assembly section drops below approximately 400° F., bypasses the gases to the glass-jacketed assembly section, thereby preventing condensation of corrosive gases and acids on the surface of the steel tubes.

In view of the foregoing, it is a first object of the present ivention to provide means for economically extracting heat energy from low temperature flue gases of boilers and other fuel burning equipment.

A further object of the invention is to provide heat extraction as described which removes substantial amounts of acid-forming gases, acids and other contaminants from the flue gases.

Another object of the invention is to provide heat extraction means as described which is substantially uneffected by the acid forming flue gas contaminants.

Still another object of the invention is to provide a novel heat exchange tube assembly utilizing concentric spaced tubes of different materials having a graphite intermediate layer which accommodates the differential expansion and contraction of the dissimilar tubes upon heating and cooling while maintaining heat conductive contact with both tubes.

A further object of the invention is to provide a novel heat exchange tube assembly as described which provides a balanced heat transfer from the outer surface of the outer tube to the inner surface of the inner tube to permit thereby the use of glass, an acid impervious material, as the outer tube material in such a manner that the danger of thermal stresses causing breakage of the glass is obviated.

Still another object of the invention is to provide a heat extraction means incorporating a novel heat exchange tube assembly as described which is of a relatively simple, easily fabricated and assembled construction and which may be readily installed in conjuction with existing boilers and other fuel burning equipment.

Additional objects and advantages of the invention will be more readily apparent from the following detailed description of embodiments thereof when taken together with the accompanying drawings wherein.

Figure 10:
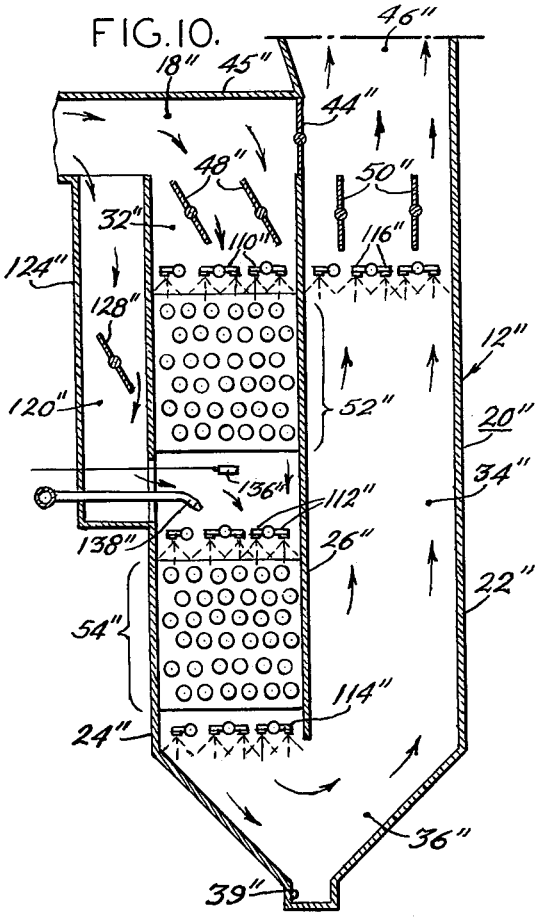
Figure 11:
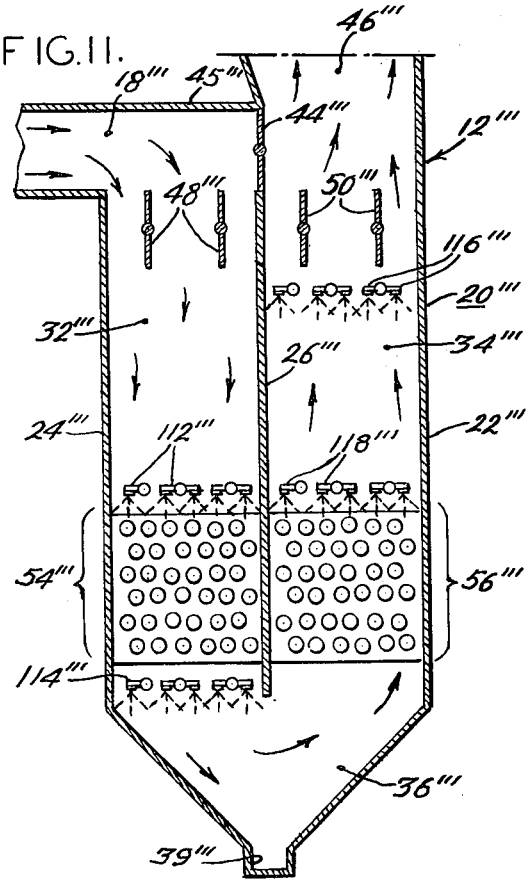

FIG. 10 is a sectional side elevational view of a further modified form of economizer in accordance with the present invention incorporating a stage of glass jacketed tube assemblies and a preceding stage of steel jacketed tube assemblies; and FIG. 11 is a sectional side elevational view of another form of economizer in accordance with the present invention incorporating a stage of glass jacketed tube assemblies followed by a stage of steel jacketed tube assemblies.

Figure 1:
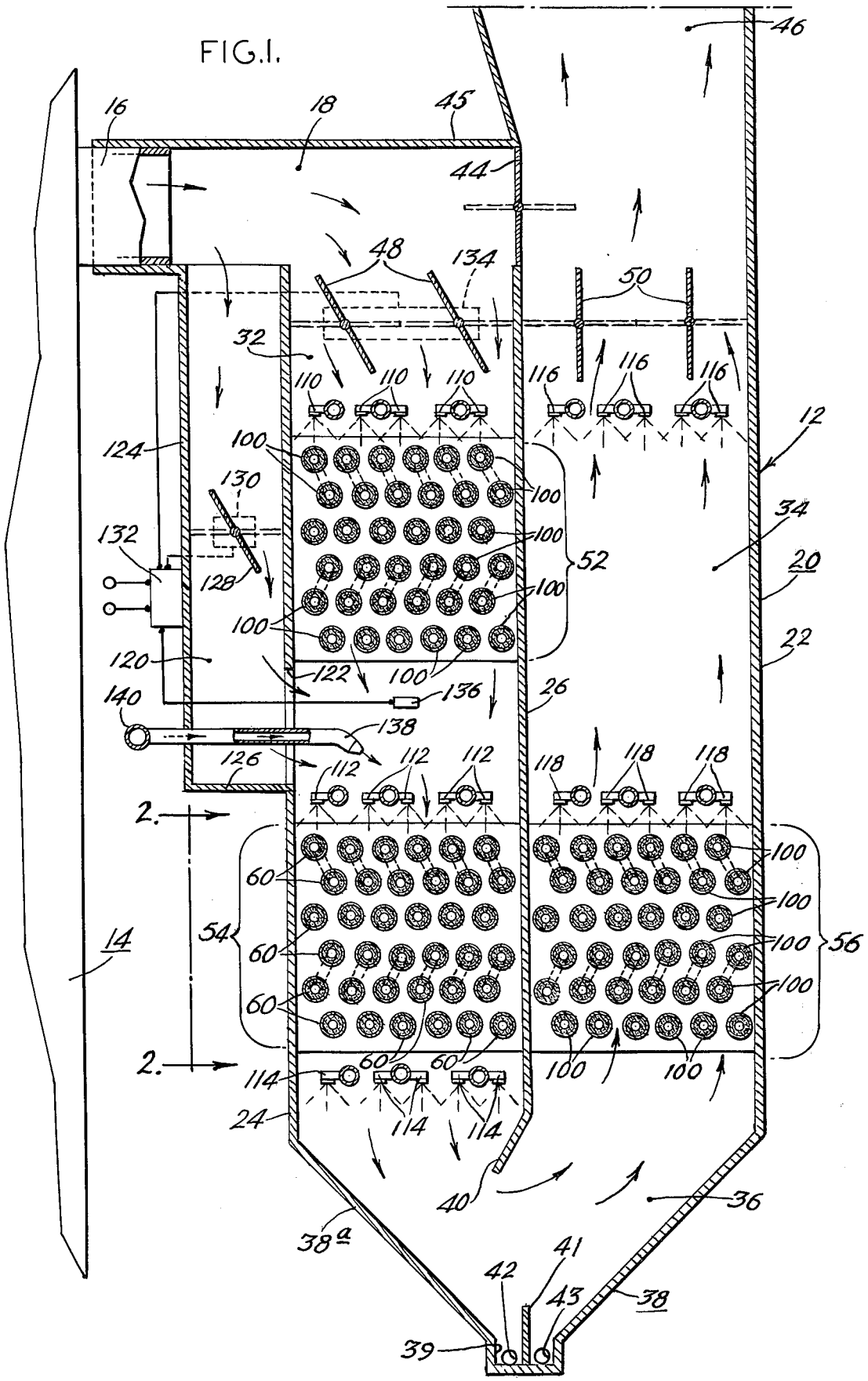
FIG. 1 is an elevational sectional view of an economizer incorporating the heat exchange tube assemblies of the present invention in a three stage configuration.

Referring to the drawings and particularly FIG. 1 thereof, an economizer generally designated 12 emobodying the present invention is illustrated in connection with a boiler 14, the back wall only of which is shown. The hot flue gases from the boiler are passed through a gas outlet 16 into an upper chamber 18 of the economizer 12. The economizer includes a casing 20 having vertical side walls 22 and 24 and an inner wall 26 parallel to the side walls and spaced midway therebetween. End walls 28 and 30 (FIG. 2) enclose support means for the heat exchange tube assemblies as described below. The economizer is rectangular in horizontal cross section and the inner wall 26 divides the interior into parallel vertical ducts 32 and 34, the ducts both opening into a large chamber 36 formed by the hopper shaped bottom 38 of the casing 20. A collecting trough 39 is formed at the bottom of the economizer to direct accumulated liquids and particulate matters to one end thereof for removal. A deflecting plate 40 at the lower end of inner wall 26 directs liquids from duct 32 toward the left wall 38*a* of the hopper bottom. A divider 41 in the trough 39 segregates the liquids from duct 32 from those dropping from the duct 34. Drain ports 42 and 43 at one end of trough 39 permit the removal of the segregated liquids from the trough 39.

A damper 44 is mounted above the upper end of inner wall 26 with its axis in aignment with the inner wall. During operation of the economizer, the damper 44 is normally in the position illustrated in FIG. 1 wherein the damper plate is aligned with the inner wall 26 and extends between the upper end of the wall 26 and a top wall 45 of the casing 20. In this closed position of the damper 44, the flue gas passing into chamber 18 flows downwardly into duct 32, through the lower chamber 36 and thence upwardly through duct 34 into the economizer outlet 46 which is a continuation of the duct 34 and which connects with the stack. An induced draft fan may be provided if desired between the economizer and the stack.

Dampers 48 and 50 are provided respectively at the upper ends of the ducts 32 and 34. Should bypassing of the enconomizer be necessary, these dampers are both closed and the damper 44 is opened to permit direct communication of the chamber 18 with the outlet 46. With the economizer is use, the dampers 50 are always in the open position illustrated in FIG. 1, while the position of dampers 48 in the particular embodiment illustrated in FIG. 1 are regulated in response to the temperature of the flue gases in the duct 32 as described below.

Heat exchange tube assemblies are arranged in stages or groups within the ducts 32 and 34 for the purpose of transferring heat from the flue gases flowing around the outside of the tube assemblies to a liquid flowing internally through the tube assemblies. In the embodiment of FIG. 1, there are three stages of heat exchange tube assemblies; a first stage 52 in the upper part of duct 32, a second state 54 in the lower part of duct 32, and a third stage 56 in the lower part of duct 34. The construction of the tube assemblies in the three stages differs only in the material used for the outer tube thereof as described below. For purpose of illustration, the tube assemblies of the second stage 54 will accordingly be described in detail in conjunction with the views thereof in FIGS. 2–5 of the drawings.

Each heat exchange tube assembly generally designated 60 of the second stage 54 comprises an outer tube 62 of low expansion borosilicate glass and an inner tube 64 of copper coaxially disposed in spaced relation within the outer tube. A graphite layer 66 is disposed intermediate the inner and outer tubes and completely fills the space therebetween. The graphite layer serves to conduct heat from the outer glass tube 62 to the inner copper tube 64 while adapting to the differential expansion and contraction of the tubes upon heating and cooling. Graphite is uniquely suited for the intermediate layer of the tube assembly in view of its resistance to high temperatures, its excellent heat conductivity characterisitcs, its low coefficient of thermal expansion which is very close to that of glass, and its amorphous character which permits a distribution of thermal stresses which might occur for example upon uneven heating of portions of the tube assemblies to avoid breakage of the glass.

Figure 3:
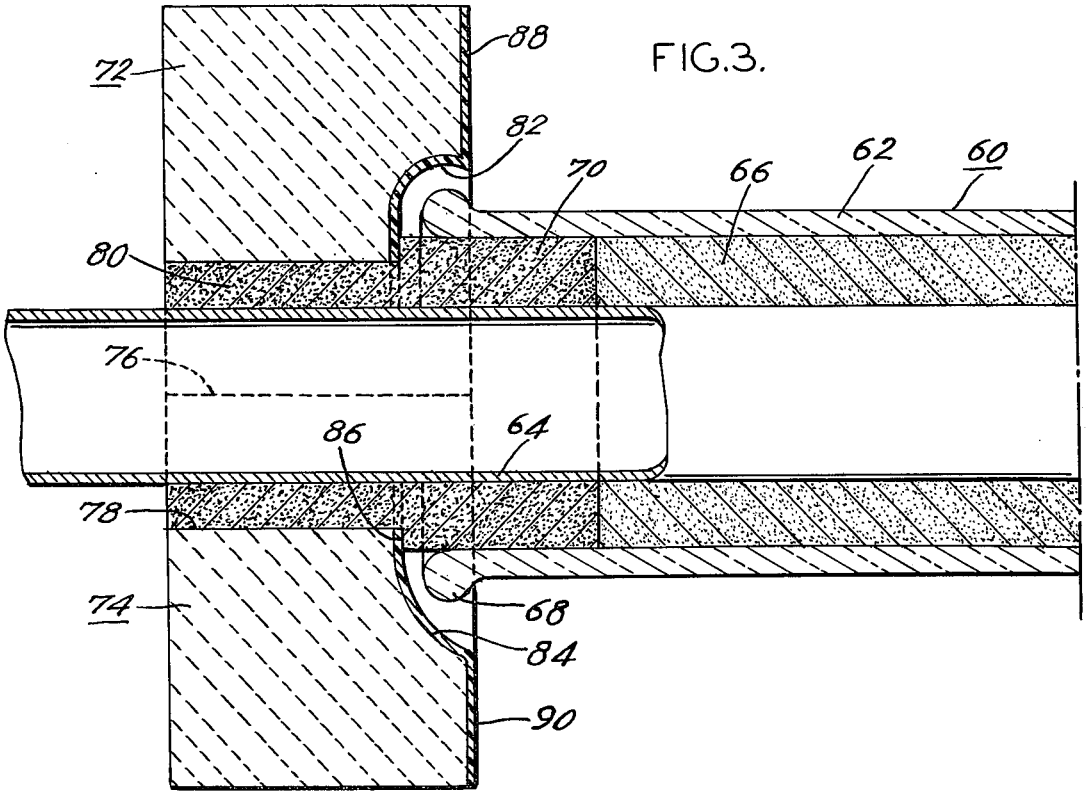
FIG. 3 is an enlarged sectional view illustrating a preferred arrangement for supporting the ends of the glass heat exchange tube assemblies.
Figure 4:
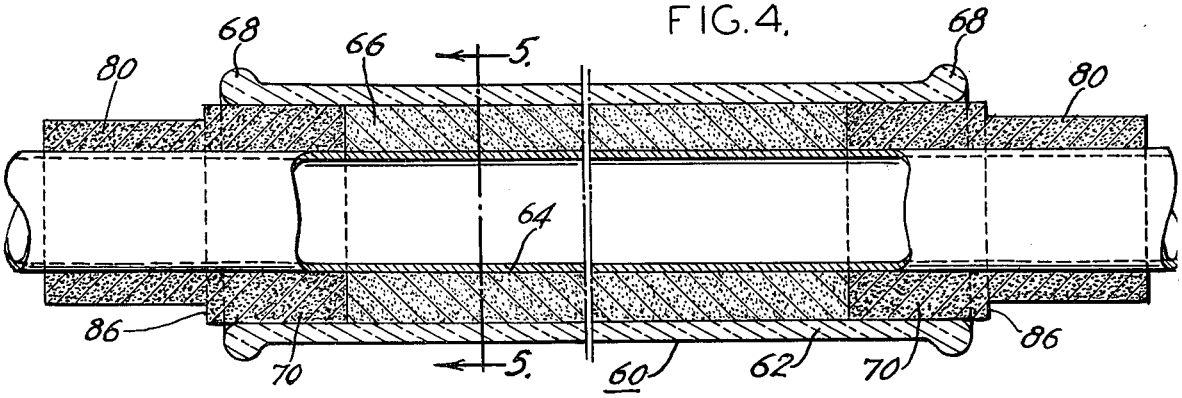
FIG. 4 is a sectional view of reduced scale in comparison with FIG. 3 taken axially through one of the glass tube assemblies.
Figure 5:
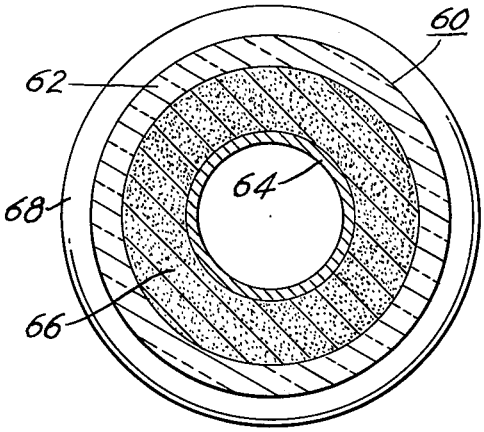
FIG. 5 is an enlarged sectional view taken along line 5—5 of FIG. 4.
Figure 6:
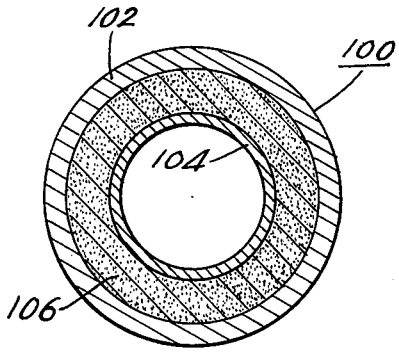
FIG. 6 is a sectional view taken through one of the steel jacketed heat exchange tube assemblies.

The support of the tube assemblies is preferably carried out as shown in FIG. 3 wherein the inner tube 64 is shown to extend axially substantially beyond the beaded end 68 of the glass tube 62. A carbon ring 70 having an inner diameter substantially equal to the outer diameter of the inner tube 64 and an outer diameter substantially equal to the inner diameter to the glass tube 62 is inserted at each end of the tube assembly between the inner and outer tubes. The inner end of the carbon ring 70 engages the graphite layer, preventing axial shifting of the graphite. The carbon rings further serve to coaxially support and anchor the glass tube radially with respect to the copper tube while freely permitting the axial movement thereof due to thermal expansion and contraction.

Although it will be recognized that many arrangements could be utilized to support the tube ends, a typical arrangement is shown in FIG. 3 wherein refractory blocks 72 and 74 joined along a plane 76 are apertured to produce when so joined a cylindrical opening 78 therein to accept a reduced diameter bearing portion 80 of the carbon ring 70. The inner tube 64 is of sufficient axial length to extend substantially beyond the ring portion 80. The refractory bricks 72 and 74 are respectively relieved in areas 82 and 84 to form a substantially circular counterbore within which the beaded end 68 of the glass tube 62 may be received. A shoulder 86 of the carbon ring 70 formed at the beginning of the reduced diameter portion 80 thereof is spaced axially outwardly from the beaded end 68 of the glass tube 62 and engages the refractory bricks to prevent contact of the glass with the refractory, thereby allowing free expansion of the glass tube. The counterbore provided by the relieved areas 82 and 84 of the refractory bricks is preferably shaped as illustrated to direct dripping corrosive liquids which may run along the brick walls onto the glass tube and away from the carbon ring 70. A plastic or ceramic coating 88 and 90 may be applied to the inner walls of the refractory bricks 72 and 74 respectively.

Figure 2:
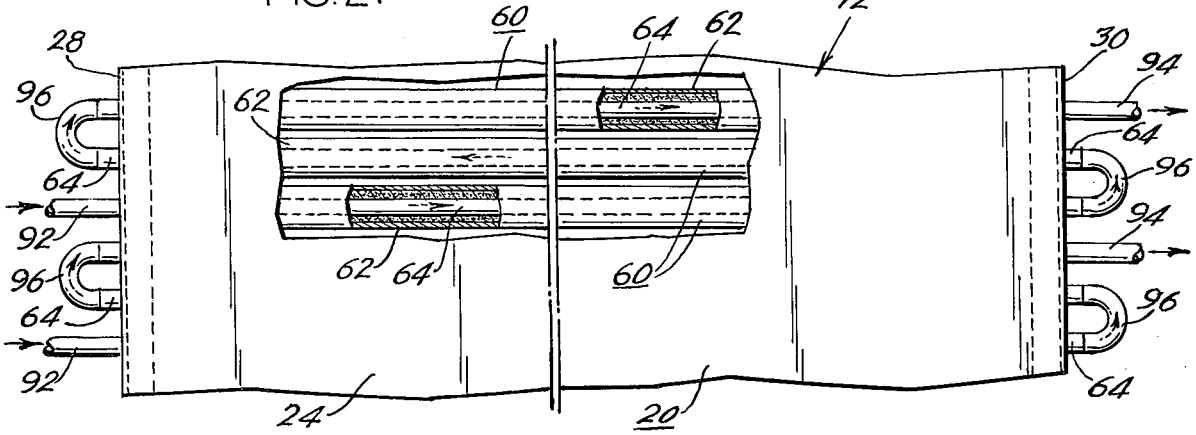
FIG. 2 is a partial side elevational view partly broken away taken along line 2—2 of FIG. 1 and illustrating the flow path of the liquid heat exchange medium through one of the three stages.

In FIG. 2, a typical arrangement of the tube assemblies within the economizer stages is illustrated. The tube assemblies 60 are arranged in parallel evenly spaced horizontal rows, there being six rows to each stage. As shown in FIG. 1, the rows are preferably arranged in an alternately offset arrangement so that the successive rows of tubes are staggered with relation to the tubes above, thereby necessitating a serpentine flow path of the flue gases to maximize the contact of the gases with the tube assemblies. As shown in FIG. 2, the tube asemblies extend the entire length of the economizer casing side wall 24 with the inner tubes 64 thereof extending beyond the casing end walls 28 and 30. In the illustrated embodiment, the tube assemblies are connected in series with the water circulating through three rows of tubes from its input at 92 to its output at 94. The tube assemblies are connected exteriorly of the economizer casing by the return bends 96 as shown in FIG. 2.

The manner of connection of the tube assemblies 60 will depend upon the temperatures of the flue gases and the liquid flowing within the tubes to be heated as well as their flow rates. In the preferred embodiment, the water to be heated is to be held below the boiling point with a maximum temperature preferably about 200° F. The water would thus normally require a relatively few passes through the tube assemblies to achieve the desired temperature. It will be apparent that more passes will be required through the tube assemblies of stage three and fewer passes through the tube assemblies of stage one in view of the cooling of the flue gases as they pass through the successive stage of the economizer. As is conventional in heat exchanger design, the flow of the liquid within the tube 60 is counter to the flow of the flue gases across the tubes.

The tube assemblies 100 of the first and third stages 52 and 56 are identical in construction to the tube assemblies 60 with the exception that the outer tube is made of steel instead of glass and the ends thereof accordingly do not terminate in the beaded configuration 68 of the glass tubes. The tube assemblies 100 accordingly include a steel outer tube 102, a coaxially disposed copper inner tube 104, and an intermediate graphite layer 106 filling the space between the outer and inner tubes 102 and 104. The ends of the tube assemblies 100 are provided with carbon rings in the same manner as those described in connection with the tube assemblies 60.

As illustrated in FIG. 1, sets of water spray nozzles 110, 112, and 114 are provided in the duct 32 respectively above the first and second heat exchange tube stages and immediately below the second stage. The spray nozzles are in each instance located along the length of the economizer so as to provide a water spray across the entire area of the duct at each location. Similarly, a set of spray nozzles 116 is located in the upper end of duct 34 and as a set of nozzles 118 is also located in duct 34 just above the third stage of heat exchange tube assemblies 56. These spray nozzles 116 and 118 spray a lime solution into duct 34 as described in more detail herebelow.

A bypass duct 120 opening into the chamber 18 at its upper end and into the duct 32 below the first stage of tube assemblies 52 through an opening 122 is formed by a vertical wall 124, a bottom wall 126, and opposed end walls (not shown) extending from the casing end walls 28 and 30. A damper 128 is disposed within the bypass duct 120 to control flue gas flow therethrough and is automatically positioned by an actuator 130 connected to a controller 132. As schematically indicated in FIG. 1, an actuator 134 is similarly connected to the dampers 48 of duct 32 and is similarly operated by the controller 132 in accordance with the temperature in the duct 32 below the first tube assembly stage 52 as sensed by the sensing device 136. The controller 132 operates to open the damper 128 while closing the dampers 48 when the temperatures in duct 32 as sensed by sensing device 136 drop below a predetermined level, for example 400° F. Conversely, should the temperature in duct 32 as sensed by the sensing device 136 rise above this level, the damper 128 is automatically closed while the dampers 48 are open to the degree necessary to provide the desired flue gas temperature in the heat exchange tube assemblies of duct 32.

Air inlet nozzles 138 extend into the duct 32 from an air supply manifold 140 and direct air downwardly into the duct 32 for reasons described below.

For operation of the economizer, the damper 44 is moved to the closed position shown in FIG. 1 to cause the flue gases from chamber 18 to flow downwardly into the upper end of duct 32 or the bypass duct 120 depending upon the position of the dampers 48 and 128. The water flow through the tube assemblies 60 and 100 of all three stages 52, 54 and 56 is begun, and the water spray from the spray nozzles 110, 112, and 114 is similarly initiated. Similarly, lime spray is directed through the spray nozzles 116 and 118 into duct 34. The air manifold 140 is pressurized and a flow of air is directed through the nozzles 138 into the region of the glass jacketed heat exchange tube assemblies of stage 54.

As inidicated above, the glass jacketed heat exchange tube assemblies 60 of the second stage 54 are most efficiently utilized with flue gases in the temperature range of 200°–500° F. It is in this temperature range that the bulk of the acid forming oxides of sulfur and acids in the flue gases will condense, and since the glass outer tube is impervious to the acids, such condensation is encouraged by the spraying of water and introduction of air into this region to accelerate the formation of sulfuric acid. A catalyst could be employed in this region if desired to speed up the conversion of sulfur dioxide to sulfur trioxide which combines quite readily with water to form the desired acid.

Although the glass jacketed tube assembly 60 are uneffected by the acids formed in the temperature of 200°–500° F. and due to the novel construction of the tube assemblies are moderately efficient heat exchangers, the glass tube assemblies are not as well suited for operation at higher or lower temperatures. At temperatures above 500° F., there is very little if any formation of acid and steel-jacketed tube assemblies may be used without the danger of excessive corrosion. Accordingly, the steel jacketed tubes can operate more efficiently in the hot region at the upper end of duct 32 where there is little risk of acid formation.

Since the flue gas temperatures normally vary to some degree depending on the load on the boiler, means are provided for bypassing the first stage of steel jacketed tube assemblies 52 should the flue gas temperature decrease. This means, as described above, comprises the controller 132 connected to the damper actuators 130 and 134. As the temperature sensed by the sensing device 136 falls below a predetermined, level, for example, 400° F., the dampers 48 are gradually closed and the damper 128 is gradually opened to the degree required to stabilize the temperature at the location of the sensing device 136. The dampers 128 and 48 will thus be frequently varied in position to insure that the steel jacketed tube assembly of the first phase 52 will never be subjected to flue gas at a sufficiently low temperature to produce corrosive acids on the tube assembly surfaces.

The water spray nozzles 110, 112 and 114 all serve to maintain a high moisture content in the duct 32 thereby raising the acid dew point temperature to accelerate the formation of the acids in the region of the glass jacketed tube assemblies. The water introduced in the upper end of the duct 32 will immediately vaporize, while the water introduced in the lower end thereof will remain in droplet form to aid in cleaning the glass tube assemblies and the walls of the duct. In addition, the water sprays will remove particulate matter such as fly ash from the flue gases.

At temperatures below 200° F., the glass jacketed tube assembly 60 are relatively inefficient at least in comparison with the steel-jacketed assemblies 100 because of the low heat conductivity of the glass and the smaller temperature differential between the flue gas and the water to be heated. The water temperature might typically be 40° or 50° F. upon introduction into the heat exchange tube assemblies an for flue gases below 200° F., the steel jacketed tube assemblies 100 are considerably more efficient. Since it is believed that the bulk of the corrosive acids and acid forming oxides will have been removed from the flue gases prior to the ascent of the gases into duct 34, a tube assembly of the third phase 56 are preferably the same steel jacketed tube assemblies 100 as utilized in phase one. A lime solution should be sprayed through the spray nozzles 116 and 118 to neutralize the acids and protect the steel outer tubes of the tube assemblies 100 in the third phase 56. The neutralized solution will drop into the trough 39 but will be segregated by the divider 41 from the acid solution from duct 32. The acid solution may be removed from trough 39 through port 42 and processed to recover valuable acid products.

From the foregoing, it will be apparent that the present economizer is designed for water heating purposes and specifically for heating untreated tap water from a temperature of approximately 50° to 200° F. The heated water may be used for industrial plants such as paper mills, die houses, laundries, and the like. The economizer is not intended for the heating of oil or feed water since such water is necessarily raised above the boiling point by deaerating heaters. The use of copper or other suitable non-ferrous material for the inner tube is essential if the water circulated therethrough has not been deaerated. If deaerated water was available, ferrous metals could be used for the inner tube if conventional water treatment procedures were followed to minimize tube corrosion.

Although graphite has been described above as the preferred material for the intermediate heat exchange tube assembly layer, it should be recognized that other particulate types of carbon can also be employed which are characterized by high heat resistance and good thermal conductivity. Examples of such carbon particulates include activated carbon, carbon black and graphite carbon. For a comprehensive text describing the many commercial forms of carbon and graphite which may have application in the present heat exchange tube assembly, see Kirk-Othmer "Encyclopedia of Chemical Technology" 2nd Ed. Vol. 4, pgs. 149–182, 304–335.

Although the preferred tube assembly embodiment comprises an intermediate layer between the inner and outer tube of graphite, or carbon as indicated above, a modified form of tube within the scope of the invention could include a filler within the graphite or carbon layer of metal scrap such as aluminum which would serve to increase the thermal conductivity of the layer without changing its mechanical adaptability to expansion and contraction stresses occurring between the inner and outer tubes. Similarly, impervious graphite, a resin bonded form of graphite having superior thermal conductivity but a low heat resistance, could be utilized adjacent the cool inner tube with a graphite or carbon layer interposed adjacent the hot outer tube. In either of such modifications, the major portion of the composition of the intermediate layer would be graphite or carbon to take advantage of their properties, particularly their high heat resistance and good thermal conductivity. Graphite or carbon is exceptionally well suited for its use as the intermediate layer since it is impervious to acids, is easily packed into the tubes, and is relatively inexpensive. The coefficient of expansion of graphite is slightly lower than that of glass, and since it will remain cooler than the glass in view of its proximity to the cooler inner tube, will not tend to crack the glass upon heating. The finely divided nature of the graphite or carbon insures a continuous surface contact of the intermediate layer with both the inner and outer tubes and a resultant efficient transfer of heat from the outer to the inner tube. Although the glass outer tube has a limited heat conductivity, the tube may be relatively thin, and is of a considerably larger diameter than the inner copper tube, therby presenting a greater heat exchange surface.

Figure 7:
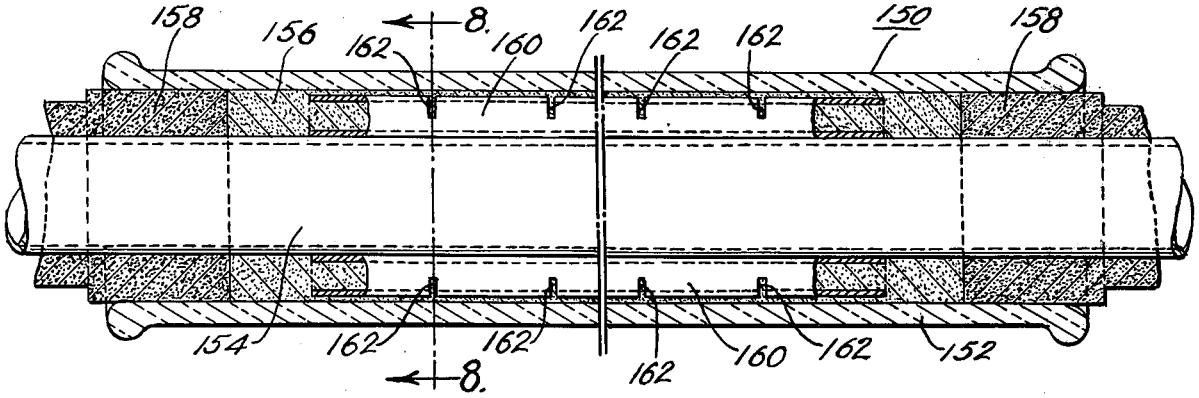
FIG. 7 is a sectional view taken axially through a modified form of glass heat exchange tube assembly.
Figure 8:
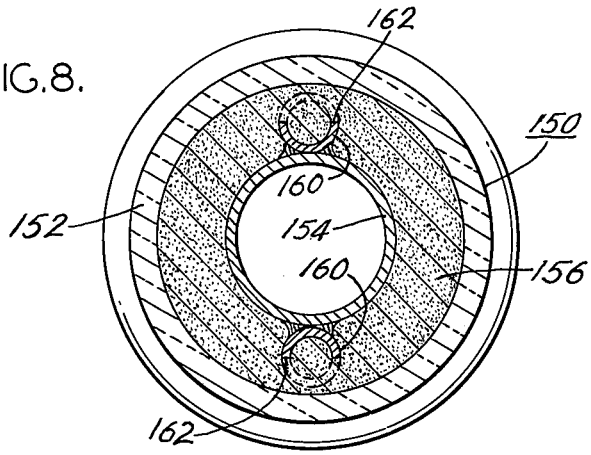
FIG. 8 is an enlarged sectional view taken along line 8—8 of FIG. 7.

A modified form of tube assembly 150 is shown in FIGS. 7 and 8 including an outer glass tube 152, an inner copper tube 154, an intermediate graphite layer 156, and carbon end rings 158. The tube assembly 150 is modified with respect to the earlier described tube assembly 60 only to the extent of the addition of stiffening means to the inner tube 154. The stiffening means comprises stiffening tubes 160 secured axially along the upper and lower exterior surfaces of the inner tube 154. The tubes 160 preferably include a plurality of spaced notches 162 extending part way transversely therethrough to relieve stresses developing due to the uneven heating of the tubes. The addition of the stiffening means is expected to be necessary only for extremely long tube assemblies.

Figure 9:
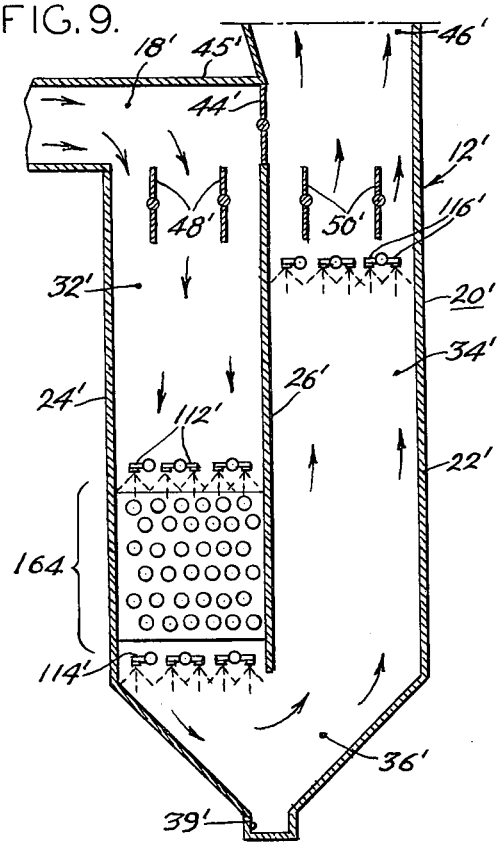
FIG. 9 is a sectional side elevational view of a modified form of economizer in accordance with the present invention incorporating a single stage of steel or glass jacketed heat exchange tube assemblies.

In FIGS. 9, 10 and 11, modified forms of the economizer of FIG. 1 are illustrated. In the FIG. 9 emmbodiment, a single phase 164 of heat exchange tube assemblies are shown in the lower end of duct 32, the first and third phases having been eliminated along with the bypass duct. The tube assemblies of the single phase 164 may be either the glass jacketed assemblies 60 or the steel jacketed assemblies 100 depending on the temperature of the flue gases and the sulfur content of the gases. If the temperature range of the flue gases should be between 200°–500° F., and the gases have a sulfur content, the glass tube assemblies are preferred. If there is no sulfur content, the steel jacketed tubes should be used.

The economizer 12'' of FIG. 10 is identical to that of FIG. 1 with the exception of the elimination of the third phase 56 of heat exchange tubes and its accompanying set of spray nozzles 118. With this arrangement, the flue gases are released to the stack at a somewhat higher temperature than with the embodiment of FIG. 1 but the cost of the steel jacketed third stage tube assemblies is eliminated along with the need to provide a lime spray and to dispose of the neutralized solutions produced thereby.

In the modification of FIG. 11, the economizer 12''' is identical to that of FIG. 1 except for the elimination of the first stage of heat exchange tube assemblies, the associated spray nozzles 110, bypass duct 120 and the air nozzles 138. The embodiment of FIG. 11 is accordingly intended for use in situations in which the flue gas temperature will not substantially exceed an upper limit of 500° F., thereby eliminating the need for the first stage steel jacketed tube assemblies.

The operation of the embodiments of FIGS. 9–11 will be obvious from the previous discussion of the operation of the embodiment of FIG. 1 and further discussion would only be repetitive.

Manifestly changes in details of construction can be effected by those skilled in the art without departing from the spirit and the scope of the present invention.

I claim:

1. An economizer comprising a duct for conducting hot flue gases from a boiler to a stack, a plurality of parallel heat exchange tube assemblies disposed within said duct extending transversely to the flow of said flue gases, said tube assemblies each comprising an outer tube of a first material, an inner tube of a second material coaxially disposed in spaced relation within said outer tube, and an intermediate layer between said inner and outer tubes completely filling the space therebetween, a major portion of the composition of said intermediate layer comprising graphite or carbon, and means for connecting said inner tubes to a source of liquid to provide a flow of liquid through said tube assemblies to transfer heat energy from said flue gases to said liquid.

2. An economizer comprising a duct for conducting hot flue gases from a boiler to a stack, a plurality of parallel heat exchange tube assemblies disposed within said duct extending transversely to the flow of said flue gases, said tube assemblies each comprising an outer tube of heat resistant borosilicate glass, a copper inner tube disposed within said glass outer tube in spaced coaxial relation therewith, and a graphite layer disposed intermediate said glass and metal tubes and completely filling the space therebetween, and means for connecting said inner tubes to a sorce of liquid to provide a flow of the liquid through said metal tubes whereby heat energy is transferred from said flue gases to said liquid.

3. The invention as claimed in claim 2 including spray nozzles disposed within said duct for directing a water spray onto said tube assemblies.

4. The invention as claimed in claim 2 including means for introducing air into said duct adjacent said tube assemblies.

5. An economizer comprising a duct for conducting hot flue gases from a boiler to a stack, a first group of parallel heat exchange tube assemblies disposed within said duct extending transversely to the flow of said flue gases, said tube assemblies each comprising an outer tube of heat resistant borosilicate glass, a metal inner tube disposed within said glass outer tube in spaced coaxial relation therewith, and an intermediate layer between said inner and outer tubes completely filling the space therebetween, a major portion of the composition of said intermediate layer comprising graphite or carbon, a second group of parallel heat exchange tube assemblies disposed within said duct extending transversely to the flow of said flue gases, said second group of heat exchange tube assemblies being disposed downstream of said first group of tube assemblies with respect to the flow of said flue gases, each tube assembly of said second group comprising a steel outer tube, a metal inner tube disposed within said steel outer tube in spaced coaxial relation therewith, and an intermediate layer between said inner and outer tubes completely filling the space therebetween, a major portion of the composition of said latter intermediate layer comprising graphite or carbon, and means for connecting the inner tubes of said first and second group of tube assemblies to a source of liquid to provide a flow of the liquid through said metal tubes whereby heat energy is transferred from said flue gases to said liquid.

6. An economizer comprising a duct for conducting hot flue gases from a boiler to a stack, a first group of parallel heat exchange tube assemblies disposed within said duct extending transversely to the flow of said flue gases, said tube assemblies each comprising and outer steel tube, an inner metal tube disposed within said steel outer tube in spaced coaxial relation therewith, and an intermediate layer between said inner and outer tubes completely filling the space therebetween, a major portion of the composition of said intermediate layer comprising graphite or carbon, a second group of parallel heat exchange tube assemblies disposed within said duct extending transversely to the flow of said flue gases, said second group of heat exchange tube assemblies being disposed downstream of said first group of tube assemblies with respect to the flow of said flue gases, each tube assembly of said second group comprisng an outer tube of heat resistant borosilicate glass, a metal inner tube disposed within said glass outer tube in spaced coaxial relation therewith, and an intermediate layer between said inner and outer tubes completely filling the space therebetween, a major portion of the composition of said latter intermediate layer comprising graphite or carbon, and means for connecting the inner tubes of said first and second group of tube assemblies to a source of liquid to provide a flow of the liquid through said metal tubes whereby heat energy is transferred from said flue gases to said liquid.

7. The invention as claimed in claim 6 including a bypass duct for bypassing flue gases around said first group of heat exchange tube assemblies, and means for automatically controlling flue gas flow through said bypass duct in response to flue gas temperature variations.

8. The invention as claimed in claim 6 including a third group of parallel heat exchange tube assemblies disposed within said duct extending transversely to the flow of said flue gases, said third group of tube assemblies being disposed downstream of said second group of tube assemblies, each of the tube assemblies of said third group of tube assemblies having the same construction as those of said first group of tube assemblies.

* * * * *

UNITED STATES PATENT OFFICE

CERTIFICATE OF CORRECTION

PATENT NO. : 4,031,862

DATED : June 28, 1977

INVENTOR(S) : FRANK J. SMITH

It is certified that error appears in the above-identified patent and that said Letters Patent are hereby corrected as shown below:

Column 3, line 14 after "an" insert --end--;

line 63 change "large" to --lower--.

Column 7, line 63 change "an" to --and--.

Column 8, line 33 change "graphite" to --graphitic--;

line 38 change "182" to --282--;

line 55 after "their" insert --unique--.

Column 9, line 21 change "emmbodi-" to --embodi--.

Column 10, line 18 change "sorce" to --source--.

Column 11, line 5 change "prisng" to --prising--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*